US010199758B2

(12) United States Patent
Suzuki et al.

(10) Patent No.: US 10,199,758 B2
(45) Date of Patent: Feb. 5, 2019

(54) CONTACT

(71) Applicant: SMK Corporation, Tokyo (JP)

(72) Inventors: Satoru Suzuki, Saitama (JP); Mitsuhiro Yoshida, Kanagawa (JP); Shogo Uehara, Kanagawa (JP); Shinya Okumura, Kanagawa (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 15/943,720

(22) Filed: Apr. 3, 2018

(65) Prior Publication Data

US 2018/0366855 A1 Dec. 20, 2018

(30) Foreign Application Priority Data

Jun. 14, 2017 (JP) ..... 2017-117003

(51) Int. Cl.

| | |
|---|---|
| ***H01R 13/11*** | (2006.01) |
| ***H01R 12/00*** | (2006.01) |
| ***H01R 13/115*** | (2006.01) |
| ***H01R 13/422*** | (2006.01) |
| ***H01R 12/71*** | (2011.01) |
| ***H01R 13/64*** | (2006.01) |
| ***H01R 13/20*** | (2006.01) |

(52) U.S. Cl.

CPC ..... *H01R 13/115* (2013.01); *H01R 12/71* (2013.01); *H01R 13/20* (2013.01); *H01R 13/4223* (2013.01); *H01R 13/64* (2013.01)

(58) Field of Classification Search

None

See application file for complete search history.

(56) References Cited

U.S. PATENT DOCUMENTS

| | | | | |
|---|---|---|---|---|
| 7,537,497 | B2 * | 5/2009 | Tyler | H01R 13/187 439/843 |
| 9,118,130 | B1 * | 8/2015 | Volpone | H01R 13/115 |
| 9,515,396 | B2 * | 12/2016 | Chikusa | H01R 13/113 |
| 9,748,685 | B2 * | 8/2017 | Oba | H01R 4/023 |
| 2013/0316586 | A1 | 11/2013 | Nagamine | |

FOREIGN PATENT DOCUMENTS

| | | | |
|---|---|---|---|
| JP | 2016015293 | A | 1/2016 |
| JP | 5922295 | B1 | 5/2016 |
| WO | WO2017069076 | A1 | 4/2017 |

OTHER PUBLICATIONS

Office Action issued for counterpart Japanese Application 2017-117003, issued by the Japan Patent Office dated Oct. 20, 2017.

* cited by examiner

*Primary Examiner* — Xuong Chung Trans

(57) ABSTRACT

A contact includes a contact unit in contact with a terminal of a circuit board, to establish electric connection; and a barrel unit to contain the contact unit. The contact unit has a first contact point to come into contact with the terminal in an early stage of a relative slide operation in a connection direction when connected to the circuit board, and to be inclined according to the slide operation; a second contact point to swing toward the circuit board according to the inclination of the first contact point, and to be brought into contact with the terminal after a delay from the contact of the first contact point against the terminal; and a contact fulcrum portion. The barrel unit has protrusion support portions to support the contact fulcrum portion. Contact surfaces between the contact fulcrum portion and the protrusion support portions are each a rolled surface.

2 Claims, 7 Drawing Sheets

CONTACT

CROSS REFERENCE TO RELATED APPLICATION

The contents of the following Japanese patent application are incorporated herein by reference, Japanese Patent Application No. 2017-117003 filed on Jun. 14, 2017.

FIELD

The present invention relates to a contact having a two-point contact structure.

BACKGROUND

Conventionally, when circuit boards on or in which electronic circuits and the like are printed are connected to electronic equipment and the like, card edge contacts that combine card edge circuit boards having terminals formed at end portions of the circuit boards with contacts to be connected, and the like are known, in order to directly connect the circuit boards to the contacts (for example, refer to Patent Literature 1).

In a card edge contact described in Patent Literature 1, a contact terminal includes a circuit board terminal connection unit 2 to be connected to a circuit board terminal 15 provided at an end portion 14a of a circuit board 14, in order to connect between a conductor 25 and the circuit board terminal 15. The circuit board terminal connection unit 2 has a swing contact unit 7 that includes a first contact piece 9 and a second contact piece 10. The first contact piece 9 comes into contact with the end portion 14a of the circuit board 14 in an early stage of a relative slide operation in a connection direction between the circuit board 14 and the contact terminal, and is inclined in accordance with the further slide operation. The second contact piece 10 swings toward the circuit board terminal 15 owing to the inclination of the first contact piece 9, and is brought into contact with the circuit board terminal 15, after a delay from the contact of the first contact piece 9 with the end portion 14a of the circuit board 14.

Owing to the above-described structure, the card edge contact according to Patent Literature 1 provides a preferable contact state with the circuit board terminal, even if a circuit board residue and the like adhere.

CITATION LIST

Patent Literature

Patent Literature 1: Japanese Patent No. 5922295

SUMMARY

Technical Problem

By the way, when a contact has such a seesaw structure that is in contact with a circuit board at two points, a die of the contact has a very complicated structure. Therefore, the contact is made into a two-piece structure by being divided into a contact unit that is in contact with the circuit board and a barrel unit that contains the contact unit, for the purpose of simplifying the structure of the die.

However, connecting the divided contact unit and barrel unit only by swaging or welding may not be able to provide a sufficient electric path, and may destabilize the resistance value of the contact.

To solve such a problem, the present invention aims at providing a contact that can ensure a stable electric connection with a circuit board, while shaving during contact between the circuit board and a contact unit is reduced.

Solution to Problem

To achieve the aforementioned object, a contact according to one aspect of the present invention includes a contact unit configured to be in contact with a circuit board terminal of a circuit board, to establish electric connection; and a barrel unit configured to contain the contact unit. The contact unit has a first contact point configured to come into contact with the circuit board terminal of the circuit board in an early stage of a relative slide operation in a connection direction when the contact is connected to the circuit board, and to be inclined in accordance with the slide operation; a second contact point configured to swing toward the circuit board in accordance with the inclination of the first contact point, and to be brought into contact with the circuit board terminal after a delay from the contact of the first contact point against the circuit board terminal; and a contact fulcrum portion configured to extend between the first contact point and the second contact point, and to be pressed against the barrel unit in accordance with the inclination of the first contact point, and come into contact with the barrel unit. The barrel unit has a protrusion support portion configured to support the contact fulcrum portion in a container wall surface portion configured to contain the contact unit; and a container bottom surface portion configured to be in contact with the contact unit. Contact surfaces between the contact fulcrum portion and the protrusion support portion are each a rolled surface.

According to this structure, since the contact surfaces between the contact fulcrum portion provided in the contact unit and the protrusion support portion provided in the barrel unit are each the rolled surface, the contact according to one aspect of the present invention can ensure a sufficient electric path, and ensure stable electric connection to the circuit board, as compared with the case of adopting a fracture surface, or the case of connecting between the contact unit and the barrel unit only by swaging or welding.

The two points, i.e. the first contact point and the second contact point, are provided in the contact unit as the contact points with the circuit board. The second contact point is not usually in contact with the circuit board, but is in contact with the circuit board after the first contact point is in contact with the circuit board. Therefore, it is possible to reduce shaving during contact between the circuit board and the contact unit.

In the contact having the aforementioned structure, the contact unit may have a bottom surface portion configured to be in contact with the container bottom surface portion; an inclined surface portion that is inclined diagonally upward from the bottom surface portion; a first bent portion that is bent upward in a shape of a letter U in a vicinity of the first contact point; and a second bent portion that is bent downward in a shape of a letter U in a vicinity of the second contact point.

According to this structure, since the contact unit is bent at the two points, i.e. the first bent portion and the second bent portion, the contact according to one aspect of the present invention can save space for an occupation area of the contact unit having the two-point contact seesaw structure.

In the contact having the aforementioned structure, the barrel unit may have a swaging portion configured to swage one end of the bottom surface portion.

According to this structure, the barrel unit and the contact unit are connected to each other without fail by swaging the one end of the bottom surface portion using the swaging portion, and the contact according to one aspect of the present invention therefore has a stable resistance value.

In the contact having the aforementioned structure, the barrel unit may have a burr portion that is subjected to a burring process, at one end of the container bottom surface portion. The burr portion may be engaged with a hole provided in the bottom surface portion.

According to this structure, by engaging the burr portion with the hole, the barrel unit and the contact unit are connected to each other without fail, and the contact according to one aspect of the present invention therefore has a stable resistance value.

According to one aspect of the present invention, stable electric connection to the circuit board can be ensured, while reducing shaving during contact between the circuit board and the contact unit.

DESCRIPTION OF EMBODIMENTS

Figure 1A:
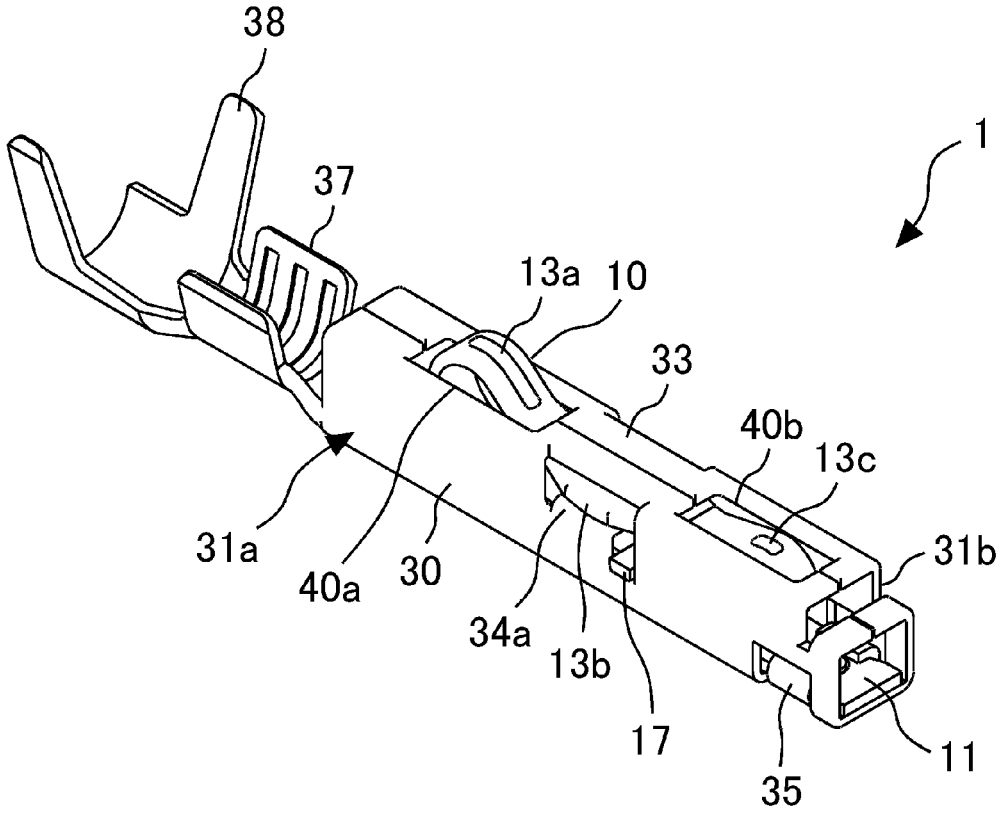
FIG. 1A is a perspective view illustrating a contact according to an embodiment of the present invention.
Figure 1B:
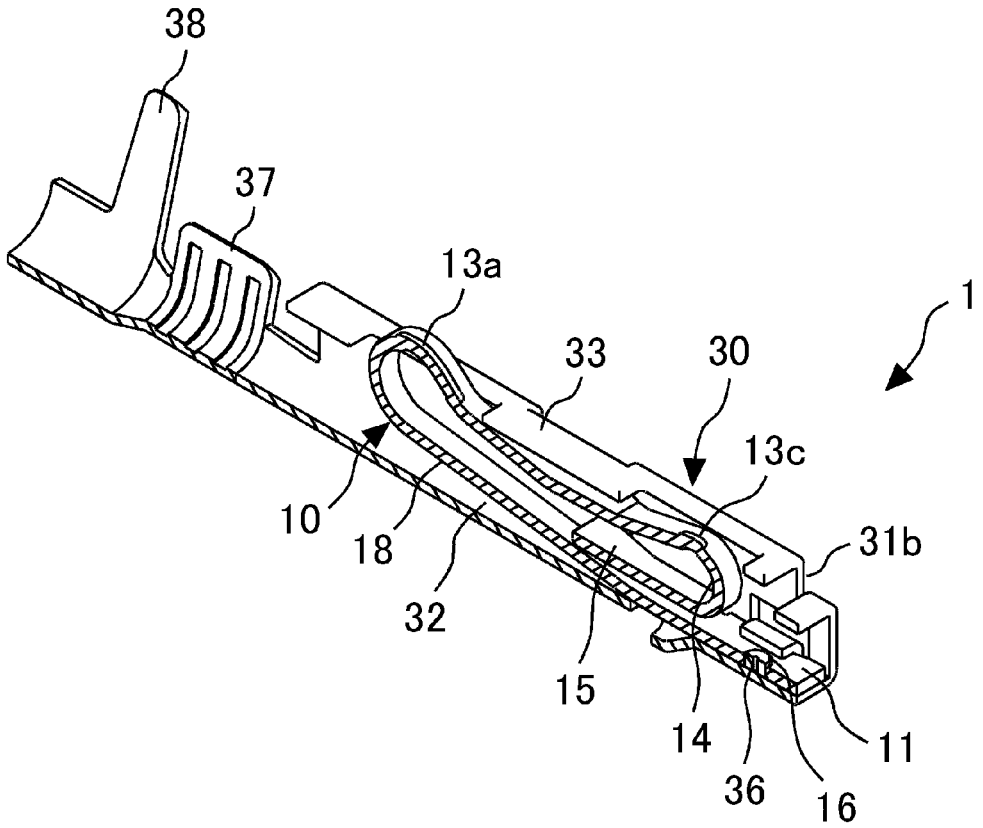
FIG. 1B is a perspective view of a longitudinal cross section of the contact.
Figure 1C:
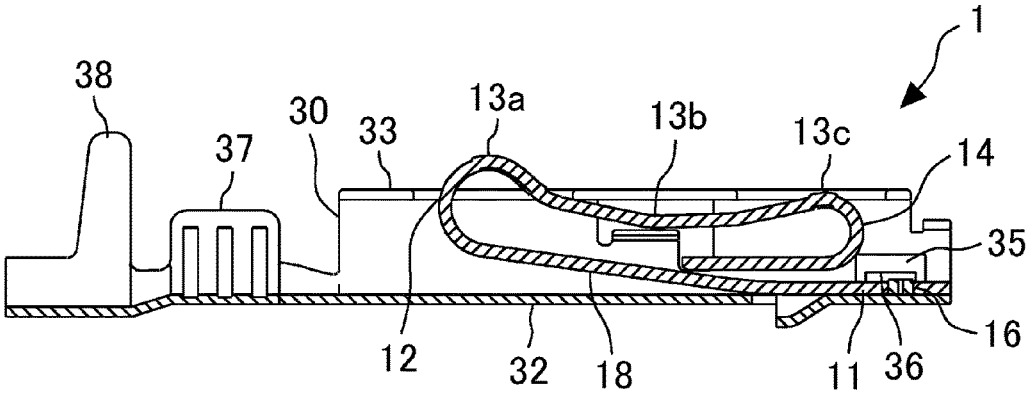
FIG. 1C is a longitudinal sectional view of the contact.

A contact 1 according to an embodiment will be described below with reference to FIGS. 1A to 4C. FIG. 1A is a perspective view illustrating the contact according to this embodiment. FIG. 1B is a perspective view of a longitudinal cross section of the contact, and FIG. 1C is a longitudinal sectional view of the contact.

The contact 1 includes a contact unit 10 and a barrel unit 30. The barrel unit 30 contains the contact unit 10. The contact unit 10 has a first contact point 13*a* protruding upward from a top surface opening 40*a* of the barrel unit 30.

When the contact unit 10 is not connected to a circuit board 50, a second contact point 13*c* is positioned at such a height as not to protrude upward from a top surface opening 40*b*. When the contact unit 10 is connected to the circuit board 50, as described later, the second contact point 13*c* moves upward and is brought into contact with a circuit board terminal 51.

Figure 2:
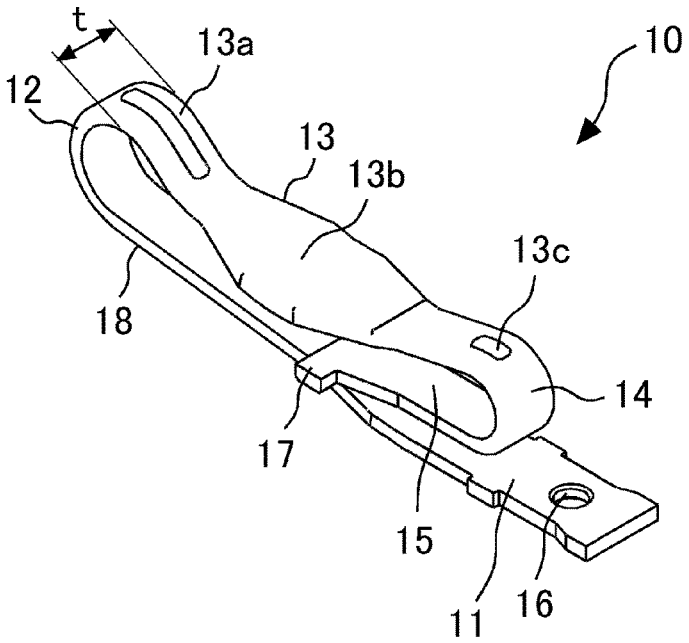
FIG. 2 is a perspective view of a contact unit according to the embodiment of the present invention.

FIG. 2 is a perspective view of the contact unit 10 according to the embodiment. The contact unit 10 is in contact with the circuit board terminal 51 of the circuit board 50, to electrically connect the contact 1 to the circuit board 50.

The contact unit 10 has a bottom surface portion 11, an inclined surface portion 18, a top surface portion 13, a middle surface portion 15, a first bent portion 12, and a second bent portion 14. As a material for the contact unit 10, for example, a copper alloy is used.

The bottom surface portion 11 is a portion configured to be in contact with a container bottom surface portion 32 of the barrel unit 30. The bottom surface portion 11 has an approximately circular hole 16 at its one end. Since the hole 16 is engaged with a burr portion 36, which is formed at one end of the container bottom surface portion 32 by a burring process, the contact unit 10 is connected to the barrel unit 30 without fail. This stabilizes the resistance value of the contact 1.

The inclined surface portion 18 is a portion that is inclined diagonally upward from the bottom surface portion 11, so as not to be in contact with the container bottom surface portion 32. As described later, when the contact 1 is connected to the circuit board 50, the inclined surface portion 18 is inclined downward in accordance with an inclination of the first contact point 13*a*, and comes into contact with the container bottom surface portion 32.

The first bent portion 12 is continued from the inclined surface portion 18. The first bent portion 12 is bent upward in the shape of the letter U in the vicinity of the first contact point 13*a*, and is continued to the top surface portion 13.

The top surface portion 13 has the first contact point 13*a*, a contact fulcrum portion 13*b*, and the second contact point 13*c*. The first contact point 13*a* comes into contact with the circuit board terminal 51 of the circuit board 50, in an early stage of a relative slide operation in a connection direction to the circuit board 50, in other words, in a horizontal direction shown in FIGS. 4A and 4B.

Figure 4A:
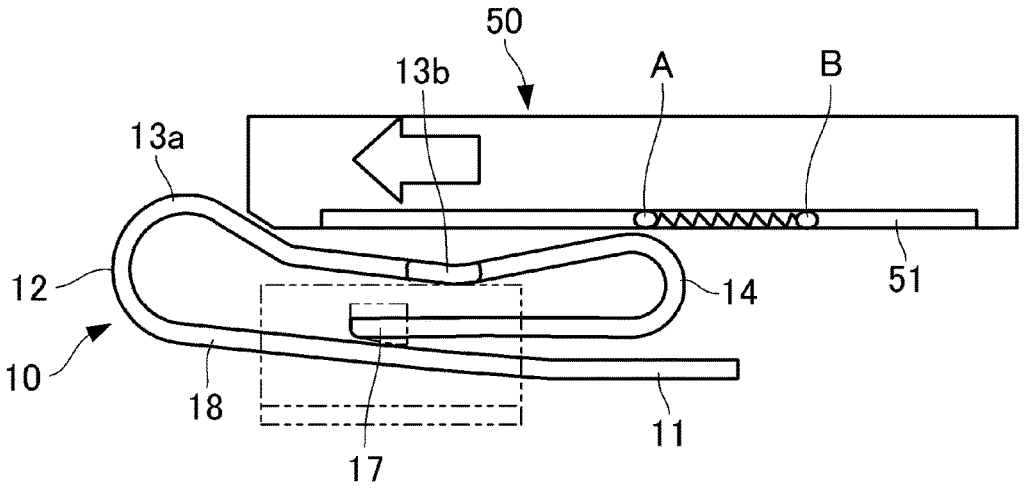
FIG. 4A shows a state immediately before the contact comes into contact with a circuit board.
Figure 4B:
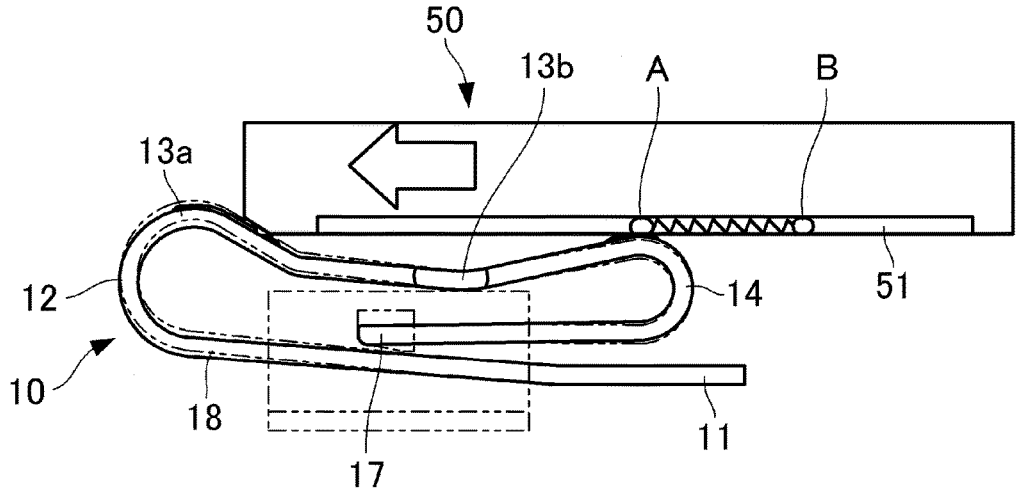
FIG. 4B shows a state in which the contact starts coming into contact with the circuit board.
Figure 4C:
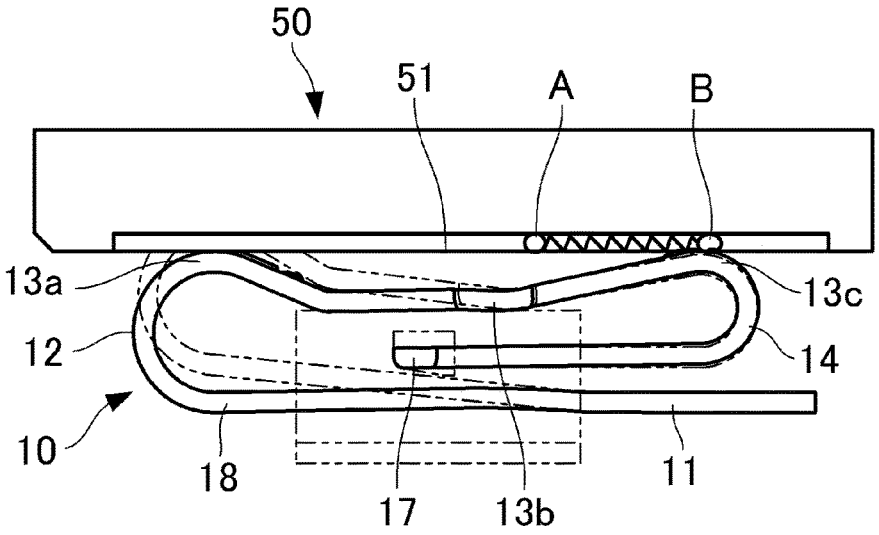
FIG. 4C shows a state in which the contact is completely connected to the circuit board.

In a state in which the contact unit 10 is completely connected to the circuit board terminal 51, as shown in FIG. 4C, the first contact point 13*a* is pressed by the circuit board terminal 51, and is inclined downward, as compared with the position before the connection.

The second contact point 13*c* swings toward the circuit board 50, contrarily to the first contact point 13*a*, in accordance with the inclination of the first contact point 13*a*. After the first contact point 13*a* comes into contact with the circuit board terminal 51, as shown in FIGS. 4A and 4B, the second contact point 13*c* moves upward on the basis of the principle of the lever, and is brought into contact with the circuit board terminal 51.

The first contact point 13*a* and the second contact point 13*c* of the top surface portion 13, which are in contact with the circuit board 50, are plated with gold, tin, or the like. The top surface portion 13 has a width t of the order of, for example, 0.6 to 0.9 mm. The contact point loads between the circuit board 50 and the first contact point 13*a*, and between the circuit board 50 and the second contact point 13*c* are of the order of, for example, 2.5 to 7.0 N. By changing the material of the contact unit 10 and the width of the top surface portion 13, the contact point loads can be arbitrarily changed.

The contact fulcrum portion 13*b* is a portion extending between the first contact point 13*a* and the second contact point 13*c*. The contact fulcrum portion 13*b* is pressed against protrusion support portions 34*a* and 34*b* of the barrel unit 30 in accordance with the inclination owing to the contact of the first contact point 13*a* with the circuit board 50, and comes into contact with the protrusion support portions 34*a* and 34*b*. The contact fulcrum portion 13*b* has elasticity and follows the protrusion support portions 34*a* and 34*b*, even when receiving an impact and the like. Thus, it is possible to ensure a stable electric path between the contact unit 10 and the barrel unit 30.

Contact surfaces between the contact fulcrum portion 13*b* and the protrusion support portions 34*a* and 34*b* are rolled surfaces. This is because the rolled surfaces can stabilize electric connection, rather than adopting fracture surfaces as the contact surfaces between the contact fulcrum portion 13*b* and the protrusion support portions 34*a* and 34*b*.

The second bent portion 14 is continued from the top surface portion 13, and is bent downward in the shape of the letter U in the vicinity of the second contact point 13*c*.

The middle surface portion 15, which is continued from the second bent portion 14, is positioned at an approximately middle height between the top surface portion 13 and the bottom surface portion 11, and extends in an approximately horizontal direction. The middle surface portion 15 is provided with engaging projection portions 17 at its one end. The engaging projection portions 17 are provided on both sides in the connection direction of the circuit board 50, so as to engage with engaged portions 39*a* and 39*b*, respectively.

Figure 3A:
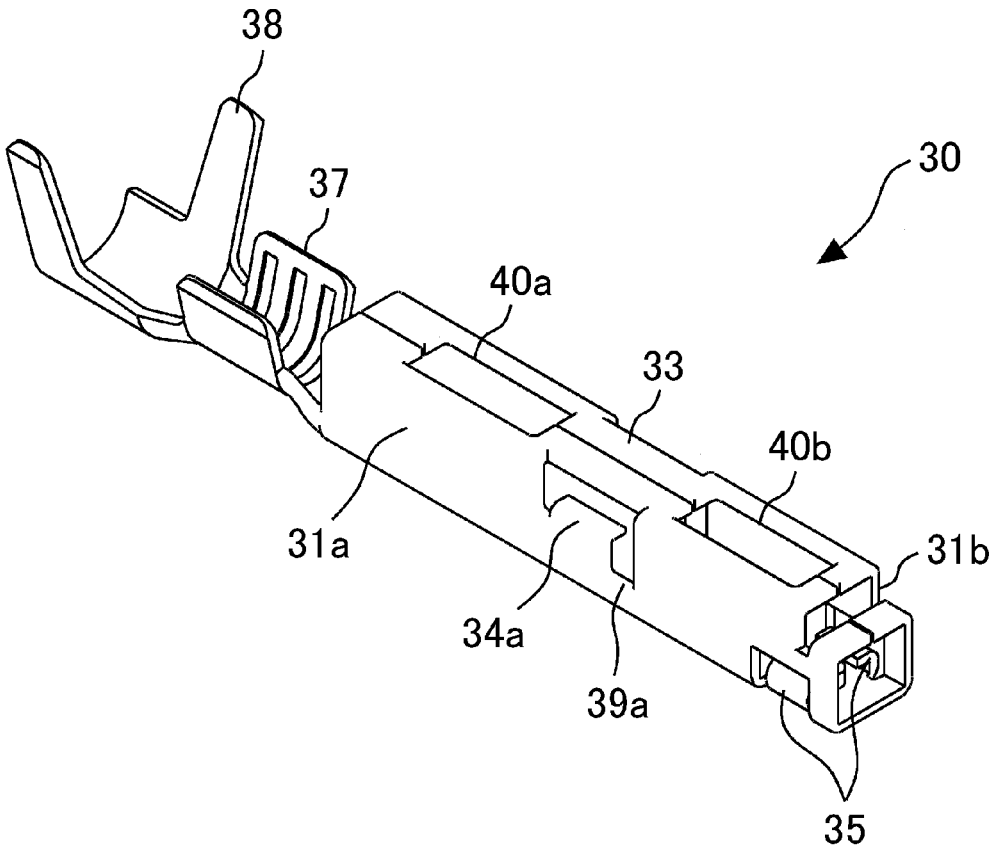
FIG. 3A is a perspective view of a barrel unit according to the embodiment of the present invention.
Figure 3B:
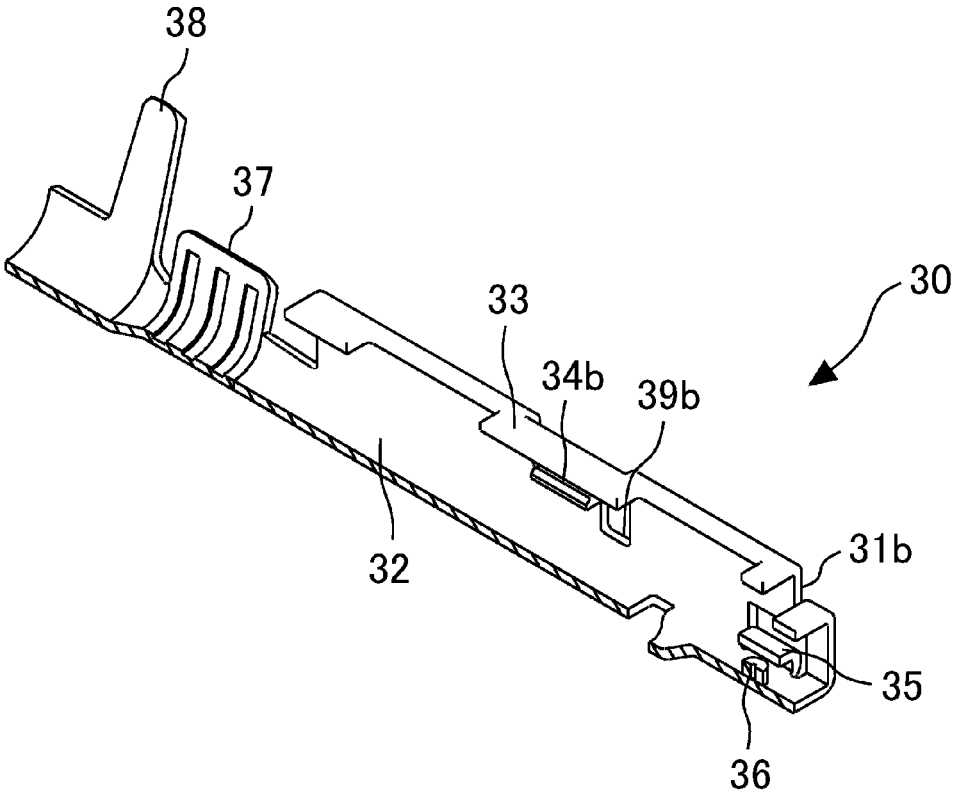
FIG. 3B is a perspective view of a longitudinal cross section of the barrel unit.

FIG. 3A is a perspective view of the barrel unit 30. FIG. 3B is a perspective view of a longitudinal cross section of the barrel unit.

The barrel unit 30 has the container bottom surface portion 32, container wall surface portions 31*a* and 31*b*, and a container top surface portion 33. The barrel unit 30 contains the contact unit 10. As a material for the barrel unit 30, for example, a copper alloy is used.

The contact 1 according to this embodiment has a two-piece structure in which the contact 1 is divided into the contact unit 10 and the barrel unit 30. This is because, if the contact has a one-piece structure in which the contact unit 10 and the barrel unit 30 are integrally formed as a one piece, a die of the contact has a very complicated structure. The contact 1 of the two-piece structure simplifies the structure of the die, thus reducing a manufacturing cost. The contact 1 of the two-piece structure allows changing the material, plate thickness, shape, and the like of the contact unit 10 and the barrel unit 30 independently.

The container bottom surface portion 32, which constitutes the bottom portion below the container space formed by the barrel unit 30, is in contact with the bottom surface portion 11 of the contact unit 10. A swaging portion 35 configured to swage the bottom surface portion 11 is provided at an end of the container bottom surface portion 32. By swaging the bottom surface portion 11 by the swaging portion 35, the barrel unit 30 and the contact unit 10 are connected to each other without fail, and the contact 1 therefore has a stable resistance value.

The container top surface portion 33, which constitutes the top portion above the container space formed by the barrel unit 30, is provided with the two top surface openings 40*a* and 40*b*. The top surface openings 40*a* and 40*b* enable the first contact point 13*a* and the second contact point 13*c* of the contact unit 10 contained in the barrel unit 30 to be in contact with the circuit board 50.

The burr portion 36, which is subjected to a burring process, is provided at an end of the container bottom surface portion 32. The approximately column-shaped burr portion 36 protrudes upward from the container bottom surface portion 32, so as to be engaged with the hole 16. Therefore, since the barrel unit 30 and the contact unit 10 are connected to each other without fail, the contact 1 has a stable resistance value.

The container wall surface portions 31*a* and 31*b* constitute side surfaces defining the container space of the barrel unit 30. The container wall surface portion 31*a* is provided with the protrusion support portion 34*a* and the engaged portion 39*a*. The container wall surface portion 31*b* is provided with the protrusion support portion 34*b* and the engaged portion 39*b*.

The protrusion support portions 34*a* and 34*b* support the contact fulcrum portion 13*b*. Contact surfaces of the protrusion support portions 34*a* and 34*b* brought into contact with the contact fulcrum portion 13*b* are rolled surfaces. This is because the rolled surfaces can stabilize electric connection, rather than adopting fracture surfaces as the contact surfaces between the contact fulcrum portion 13*b* and the protrusion support portions 34*a* and 34*b*.

The engaged portions 39*a* and 39*b* support the contact unit 10 by engagement with the engaging projection portion 17. In this embodiment, the engaged portions 39*a* and 39*b* are provided in the vicinity of the protrusion support portions 34*a* and 34*b*, respectively, but may be provided in other positions.

Electric wire holders 37 and 38 configured to hold an electric wire to establish electric connection with the contact unit 10 are coupled to the barrel unit 30. When the electric wire is set, each of the electric wire holders 37 and 38 is folded to hold the electric wire in a wound state.

Next, a process for connecting the circuit board 50 to the contact 1 will be described with reference to FIGS. 4A to 4C.

FIG. 4A shows a state immediately before the contact comes into contact with the circuit board. When the circuit board 50 is moved from this state to the direction of the arrows in the drawings, as shown in FIG. 4B, one end of the first contact point 13*a* is brought into contact with the circuit board 50 and is pressed downward. In other words, the first contact point 13*a* comes into contact with the circuit board 50 in an early stage of a relative slide operation in the direction of the arrow, and is inclined downward by the slide operation.

After that, the second contact point 13*c* moves upward on the basis of the principle of the lever using the contact fulcrum portion 13*b* as a fulcrum, and is brought into contact with the circuit board terminal 51 at a point A. In other words, the second contact point 13*c* swings toward the circuit board 50 in accordance with the inclination of the first contact point 13*a*, and is brought into contact with the circuit board terminal 51, after a delay from the contact of the first contact point 13*a* with the circuit board 50.

Next, the first contact point 13*a* and the second contact point 13*c* horizontally moves relative to the circuit board 50 moving in the direction of the arrow, and as shown in FIG. 4C, the circuit board 50 and the contact 1 are completely connected to each other.

In the state of FIG. 4C, the second contact point 13*c* is in contact with the circuit board terminal 51 at a point B. While the circuit board 50 is moved, the second contact point 13*c* is in contact with the circuit board 50 from the point A to the point B. Therefore, wearing of the circuit board can be reduced, as compared with a related contact that is in contact with a circuit board at one point. The reason therefore will be described below.

Figure 5:
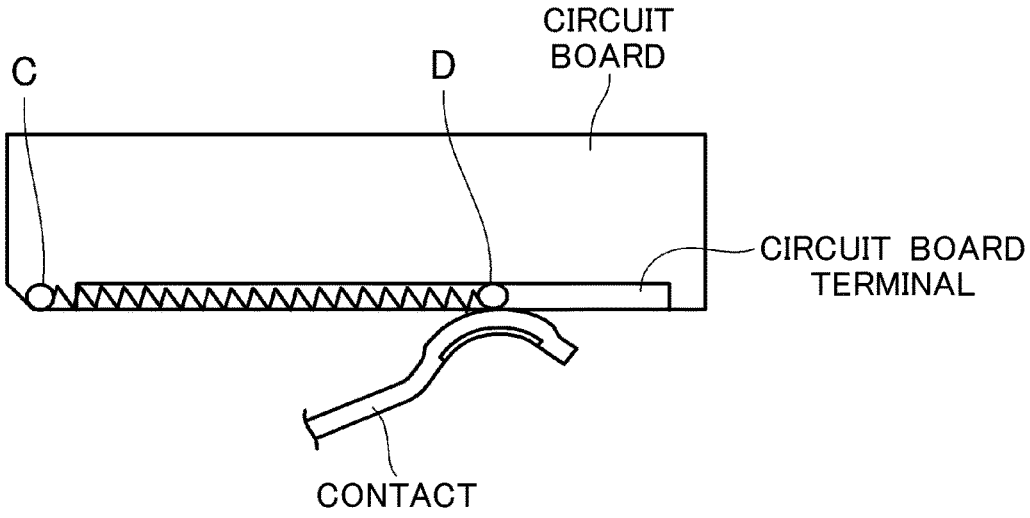
(RELATED ART) FIG. 5
FIG. 5 is a drawing showing a state in which a related contact is connected to a circuit board.

FIG. 5 shows the related type of contact that is in contact with a circuit board at one point. In the type of contact shown in FIG. 5, the contact keeps being in contact with a circuit board terminal from a point C to a point D, until the contact is completely connected to the circuit board. Thus, the circuit board tends to wear more.

On the contrary, the contact 1 according to this embodiment is of the two-point contact type in which the contact 1 can come into contact with an object by the two points, or the first contact point 13*a* and the second contact point 13*c*. The second contact point 13*c* is not in contact with the circuit board 50, until the first contact point 13*a* comes into contact with the circuit board 50. As shown in FIGS. 4B and 4C, since the second contact point 13*c* is in contact with the circuit board 50 only between the point A and the point B, the contact distance between the contact and the circuit board by the slide operation is shorter than that of the type of contact shown in FIG. 5, thus allowing a reduction in wearing of the circuit board 50. Therefore, it is possible to reduce shaving during contact between the circuit board 50 and the contact unit 10.

As described above, the contact 1 according to this embodiment includes the contact unit 10 that is in contact with the circuit board terminal 51 of the circuit board 50 to establish electric connection, and the barrel unit 30 that contains the contact unit 10. The contact unit 10 has the first contact point 13*a*, the second contact point 13*c*, and the contact fulcrum portion 13*b*. The first contact point 13*a* comes into contact with the circuit board terminal 51 of the circuit board 50 in an early stage of the relative slide operation in the connection direction when being connected to the circuit board 50, and is inclined in accordance with the further slide operation. The second contact point 13*c* swings toward the circuit board 50 in accordance with the inclination of the first contact point 13*a*, and is brought into contact with the circuit board terminal 51, after a delay from the contact of the first contact point 13*a* with the circuit board 50. The contact fulcrum portion 13*b* extends between the first contact point 13*a* and the second contact point 13*c*, and is pressed against the barrel unit 30 in accordance with the inclination of the first contact point 13*a*, and comes into contact with the barrel unit 30.

The barrel unit 30 has the protrusion support portions 34*a* and 34*b*, which support the contact fulcrum portion 13*b*, in the container wall surface portions 31*a* and 31*b* for containing the contact unit 10. The barrel unit 30 also has the container bottom surface portion 32, which is in contact with the contact unit 10. The contact surfaces between the contact fulcrum portion 13*b* and the protrusion support portions 34*a* and 34*b* are each a rolled surface.

According to this structure, since the contact surfaces between the contact fulcrum portion 13*b* provided in the contact unit 10 and the protrusion support portions 34*a* and 34*b* provided in the barrel unit 30 are each a rolled surface, the contact 1 can ensure a sufficient electric path, and ensure stable electric connection to the circuit board 50, as compared with the case of adopting fracture surfaces, or the case of connecting the contact unit 10 and the barrel unit 30 only by swaging or welding.

The two points, i.e. the first contact point 13*a* and the second contact point 13*c*, are provided in the contact unit 10 as the contact points with the circuit board 50, and the contact 1 has the two-point contact seesaw structure that uses the contact fulcrum portion 13*b*, as a fulcrum. Thus, the second contact point 13*c* is not usually in contact with the circuit board 50, but is in contact with the circuit board 50 after the first contact point 13*a* is in contact with the circuit board 50. Therefore, it is possible to reduce shaving during contact between the circuit board 50 and the contact unit 10.

Owing to the two-piece structure in which the contact 1 is divided into the contact unit 10 and the barrel unit 30, it is possible to simplify the structure of a die required in manufacture, and reduce a manufacturing cost, as compared with the case of a one-piece structure.

The contact unit 10 may include the bottom surface portion 11 that is in contact with the container bottom surface portion 32, the inclined surface portion 18 that is inclined diagonally upward from the bottom surface portion 11, the first bent portion 12 that is bent upward in the shape of the letter U in the vicinity of the first contact point 13*a*, and the second bent portion 14 that is bent downward in the shape of the letter U in the vicinity of the second contact point 13*c*.

According to this structure, since the contact unit 10 is bent at the two points, i.e. the first bent portion 12 and the second bent portion 14, the contact 1 can save space for an occupation area of the contact unit 10 having the two-point contact seesaw structure.

The barrel unit 30 may have the swaging portion 35 configured to swage one end of the bottom surface portion 11.

According to this structure, the barrel unit 30 and the contact unit 10 are connected to each other without fail by swaging the one end of the bottom surface portion 11 using the swaging portion 35, and the contact 1 therefore has a stable resistance value.

The barrel unit 30 may have the burr portion 36 in which one end of the container bottom surface portion 32 is subjected to the burring process, and the burr portion 36 may be engaged with the hole 16 provided in the bottom surface portion 11.

According to this structure, by engaging the burr portion 36 with the hole 16, the barrel unit 30 and the contact unit 10 are connected to each other without fail, and the contact 1 therefore has a stable resistance value.

As described above, the contact according to the embodiment of the present invention has the effect of ensuring electric connection to the circuit board, while reducing shaving during contact between the circuit board and the contact unit. The present invention is usefully applicable to general contacts.

REFERENCE SIGNS LIST

1 contact
10 contact unit
11 bottom surface portion
12 first bent portion
13 top surface portion
13*a* first contact point
13*b* contact fulcrum portion
13*c* second contact point
14 second bent portion
15 middle surface portion
16 hole
17 engaging projection portion
18 inclined surface portion
30 barrel unit
31*a*, 31*b* container wall surface portion
32 container bottom surface portion
33 container top surface portion
34*a*, 34*b* protrusion support portion
35 swaging portion
50 circuit board
51 circuit board terminal

The invention claimed is:

1. A contact comprising:

a contact unit configured to be in contact with a circuit board terminal of a circuit board, to establish electric connection; and a barrel unit configured to contain the contact unit, wherein the contact unit has a first contact point configured to come into contact with the circuit board terminal of the circuit board in an early stage of a relative slide operation in a connection direction when the contact is connected to the circuit board, and to be inclined in accordance with the slide operation;

a second contact point configured to swing toward the circuit board in accordance with the inclination of the first contact point, and to be brought into contact with the circuit board terminal after a delay from the contact of the first contact point against the circuit board terminal; and a contact fulcrum portion configured to extend between the first contact point and the second contact point, and to be pressed against the barrel unit in accordance with the inclination of the first contact point, and come into contact with the barrel unit, the barrel unit has a protrusion support portion configured to support the contact fulcrum portion in a container wall surface portion configured to contain the contact unit; and a container bottom surface portion configured to be in contact with the contact unit, contact surfaces between the contact fulcrum portion and the protrusion support portion are each a rolled surface, the contact unit has a bottom surface portion configured to is in contact with the container bottom surface portion;

an inclined surface portion that is inclined diagonally upward from the bottom surface portion;

a first bent portion that is bent upward in a shape of a letter U in a vicinity of the first contact point; and a second bent portion that is bent downward in a shape of a letter U in a vicinity of the second contact point, and the barrel unit has a swaging portion configured to swage one end of the bottom surface portion.

2. The contact according to claim 1, wherein the barrel unit has a burr portion that is subjected to a burring process, at one end of the container bottom surface portion, the bottom surface portion is provided with a hole, and the burr portion is configured to be engaged with the hole of the bottom surface portion.

* * * * *